US011892261B2

(12) United States Patent
Zedrosser et al.

(10) Patent No.: US 11,892,261 B2
(45) Date of Patent: Feb. 6, 2024

(54) RIFLE

(71) Applicant: FABBRICA D'ARMI PIETRO BERETTA S.P.A., Brescia (IT)

(72) Inventors: Ulrich Zedrosser, Brescia (IT); Marco Bassoli, Brescia (IT)

(73) Assignee: FABBRICA D'ARMI PIETRO BERETTA S.P.A., Brescia (IT)

( * ) Notice: Subject to any disclaimer, the term of this patent is extended or adjusted under 35 U.S.C. 154(b) by 0 days.

(21) Appl. No.: 17/968,147

(22) Filed: Oct. 18, 2022

(65) Prior Publication Data

US 2023/0123825 A1 Apr. 20, 2023

(30) Foreign Application Priority Data

Oct. 18, 2021 (IT) ..... 102021000026660

(51) Int. Cl.

| | |
|---|---|
| ***F41A 3/18*** | (2006.01) |
| ***F41A 3/26*** | (2006.01) |
| ***F41A 3/30*** | (2006.01) |
| ***F41A 15/14*** | (2006.01) |
| ***F41A 35/06*** | (2006.01) |

(52) U.S. Cl.

CPC ..... *F41A 3/26* (2013.01); *F41A 3/30* (2013.01); *F41A 15/14* (2013.01); *F41A 35/06* (2013.01)

(58) Field of Classification Search

CPC ..... F41A 3/12; F41A 3/18; F41A 3/20; F41A 3/22; F41A 3/42; F41C 7/00

See application file for complete search history.

(56) References Cited

U.S. PATENT DOCUMENTS

| | | | | |
|---|---|---|---|---|
| 3,341,963 | A | 9/1967 | Seiderman | |
| 3,653,140 | A | 4/1972 | Alday | |
| 2013/0125440 | A1 | 5/2013 | Zheng | |
| 2020/0049436 | A1 | 2/2020 | Braceras Devecchi | |
| 2022/0299280 | A1* | 9/2022 | Sunseri | F41A 3/46 |

FOREIGN PATENT DOCUMENTS

| | | |
|---|---|---|
| FR | 3 013 439 A1 | 5/2015 |
| WO | 2016/138197 A1 | 9/2016 |

OTHER PUBLICATIONS

Italian Search Report for Italian Patent Application No. 102021000026660 dated May 31, 2022, 2 pages.

* cited by examiner

*Primary Examiner* — J. Woodrow Eldred

(74) *Attorney, Agent, or Firm* — Merchant & Gould P.C.

(57) ABSTRACT

A rifle has a fixed main body including a barrel, a receiver with an upper opening, and a breech element. A carriage assembly is axially movable between an advanced shooting configuration and a retracted rearming configuration, and vice versa. The carriage assembly includes an assembly body positioned on the receiver at the upper opening, which is axially slidably movable, having a through housing extending transversally, a firearm handle with an outer portion grippable and an inner portion shaped for complementarily housing in the through housing, being insertable both sides, and a shutter group partially accommodated in the assembly body, including a shutter body and a shutter head. The shutter head is mountable onto the shutter body in first and second angular positions, which are reciprocally inverted. The rifle is configurable for a right-handed or a left-handed person by changing the position of the firearm handle and the shutter head.

14 Claims, 11 Drawing Sheets

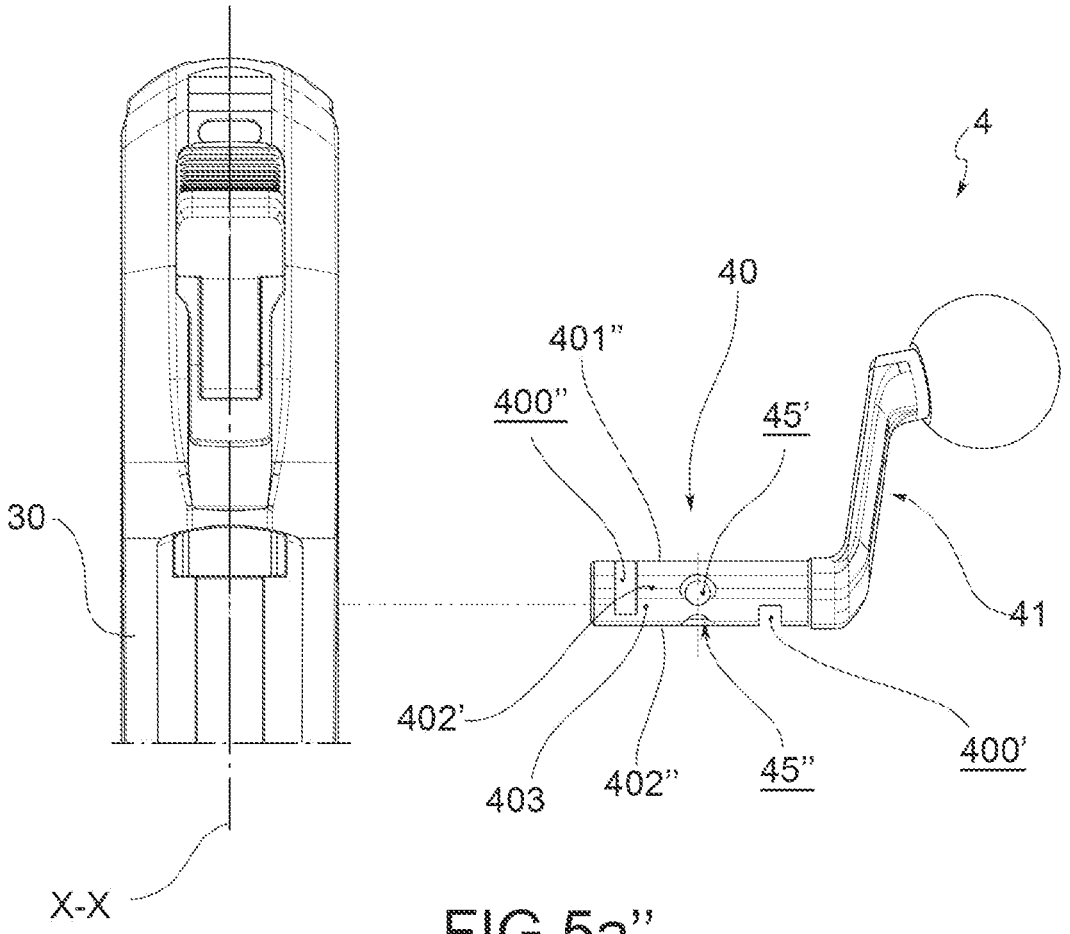
FIG.5a"
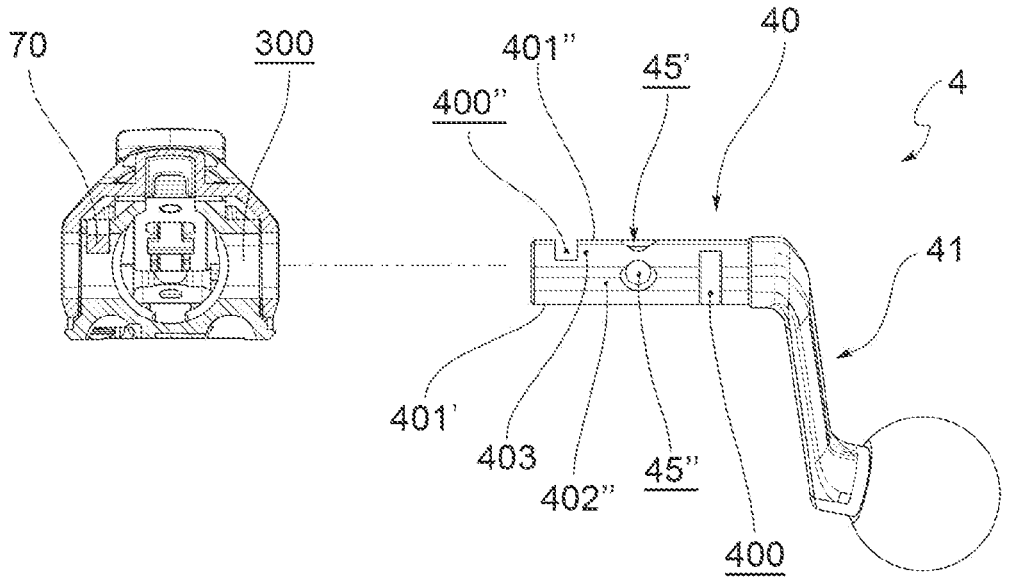
FIG.5b"

RIFLE

CROSS-REFERENCE TO RELATED APPLICATION

This application claims the benefit of Serial No. 102021000026660, filed 18 Oct. 2021 in Italy and which application is incorporated herein by reference. To the extent appropriate, a claim of priority is made to the above disclosed application.

BACKGROUND OF THE INVENTION

The present invention relates to a rifle.

In particular, the present invention relates to a rifle that is, preferably but not necessarily, a hunting rifle.

In still further detail, the rifle of the present invention is of the type in which the rearming operations are carried out by the user manually moving the carriage assembly axially.

In the prior art, rifles having said features and functioning modes are known.

Known in particular are embodiments of rifles that comprise a fixed main body graspable by the user, and a carriage assembly which is manually movable by the user for rearming the shot. In particular, it is known in such rifles to move the carriage assembly between an advanced configuration and a retracted configuration and vice versa. Preferably, such known rifle solutions comprise a firearm handle grippable by the user in order to execute said operations.

Furthermore, the known rifle solutions of this type comprise, in the carriage assemblies, shutter groups, the movement of which involves the loading operations of the bullet and the case discharge operations. In particular, the shutter group is configured for being subject of axial translation and rotation operations.

Preferably, depending on the position of the firearm handle and/or depending on the shutter position, the rifle is usable by a right-handed or left-handed user and the case is discharged to the right side or to the left side of the rifle.

Solutions of rifles for right-handed people and solutions of rifles for left-handed people are known in the prior art.

Also known are rifle solutions configurable in a user configuration for right-handed people and in a user configuration for left-handed people.

However, in order to change from one user configuration to the other, such known solutions require complex and operations for removing and installing various components.

SUMMARY OF THE INVENTION

The object of the present invention is to supply a rifle solution that is an alternative to such known solutions of the prior art, wherein the operations which allow said change of configuration are easy, safe and intuitive.

BRIEF DESCRIPTION OF THE DRAWINGS

In addition, further features and advantages of the invention will become clear from the description provided below of the preferred embodiments thereof given as non-limiting examples in reference to the attached figures, wherein:

FIGS. 1*a*' and 1*b*' illustrate side views of the rifle shown in FIGS. 1*a* and 1*b;*

FIG. 4' is a lateral view of separate parts of an assembly body and of a shutter group comprised within the carriage assembly shown in FIG. 2;

FIGS. 5*a*" and 5*b*" show, respectively, a top view of separate parts and a frontal view in partial cross section of the carriage assembly from the preceding figures according to a second user configuration;

DETAILED DESCRIPTION OF THE PREFERRED EMBODIMENTS

Figures 1A, 1B:
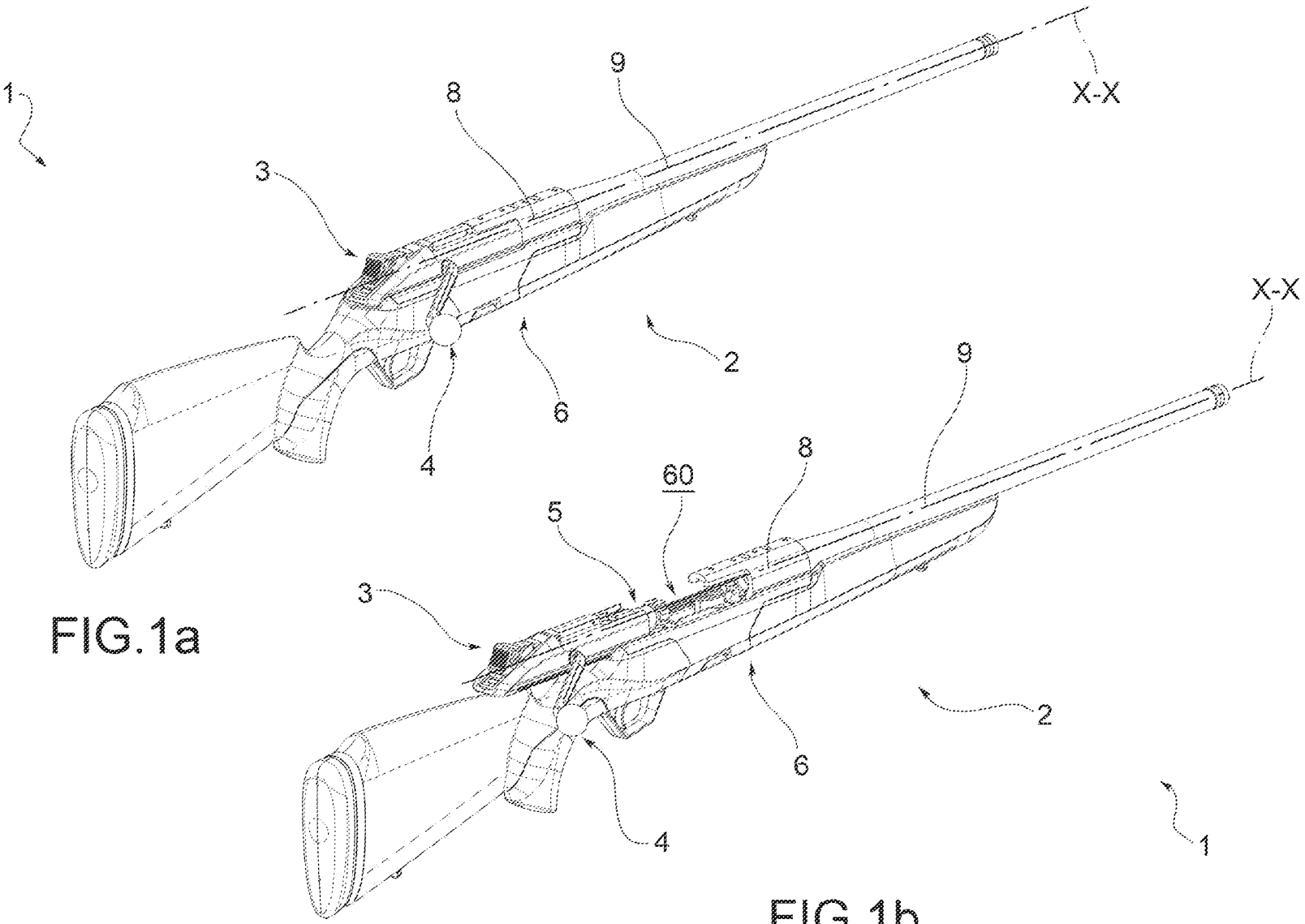
FIGS. 1*a* and 1*b* show a perspective view of a rifle according to the present invention, wherein the carriage assembly comprised therein according to a preferred embodiment is in an advanced shooting configuration and in a retracted rearming configuration.
Figure 1A:
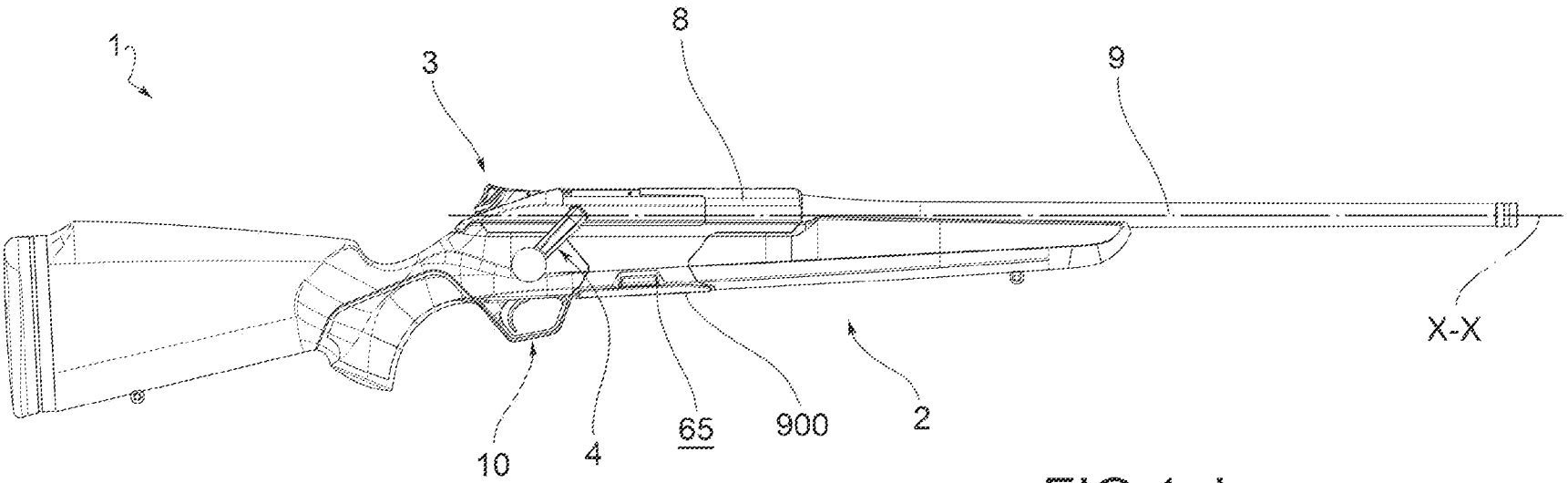
Figure 1B:
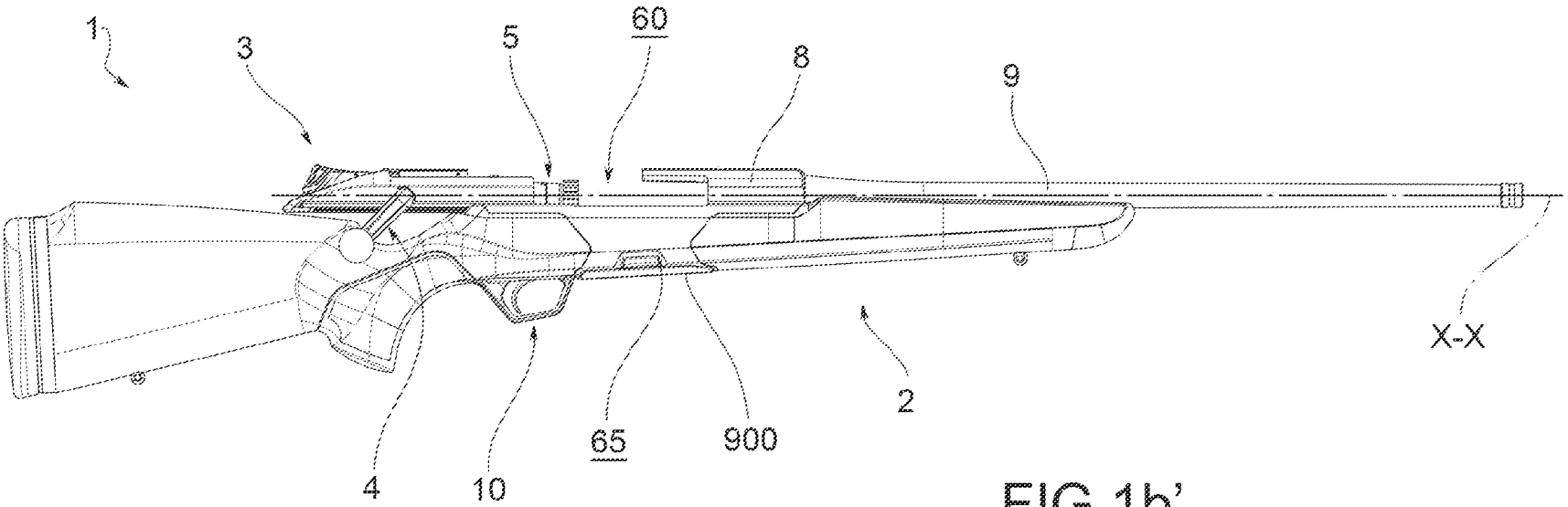
Figure 2:
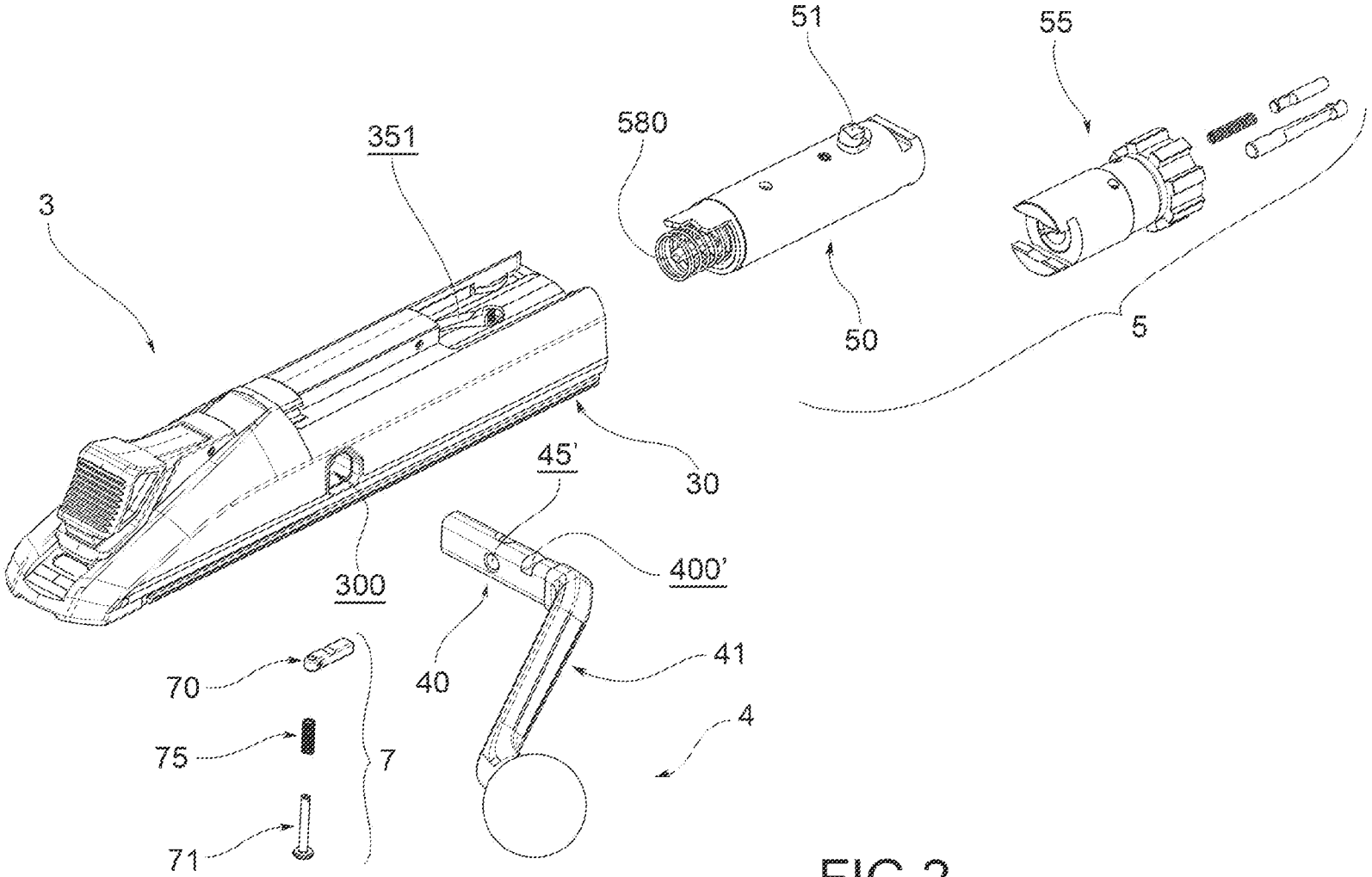
FIG. 2 is a perspective view of separate parts of a carriage assembly comprised within the rifle shown in FIGS. 1*a* and 1*b;*
Figure 3A:
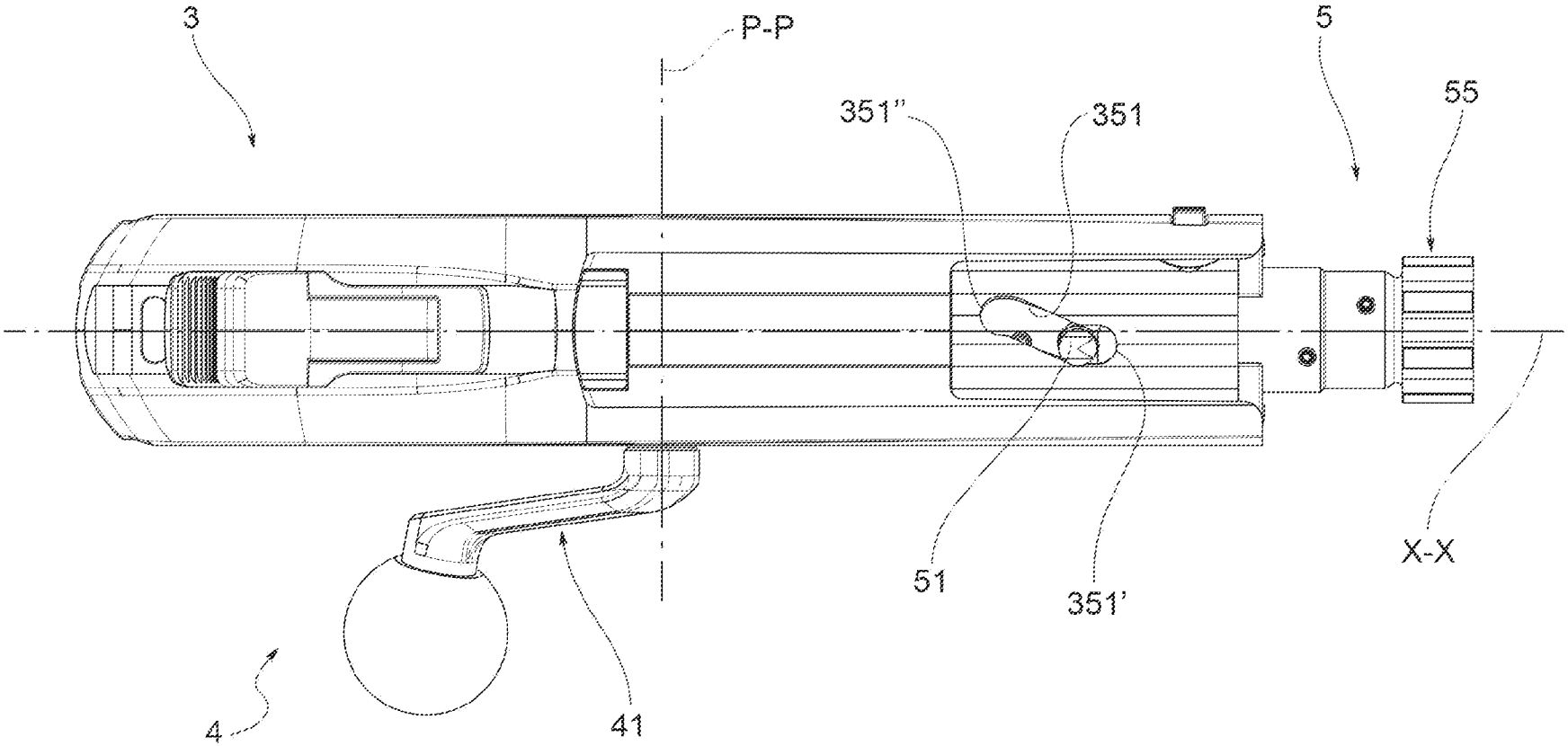
FIGS. 3*a*, 3*b* and 3*c* are, respectively, a view from above, a side view in partial cross section, and a front view of the carriage assembly from FIG. 2 assembled in a first user configuration.
Figure 3B:
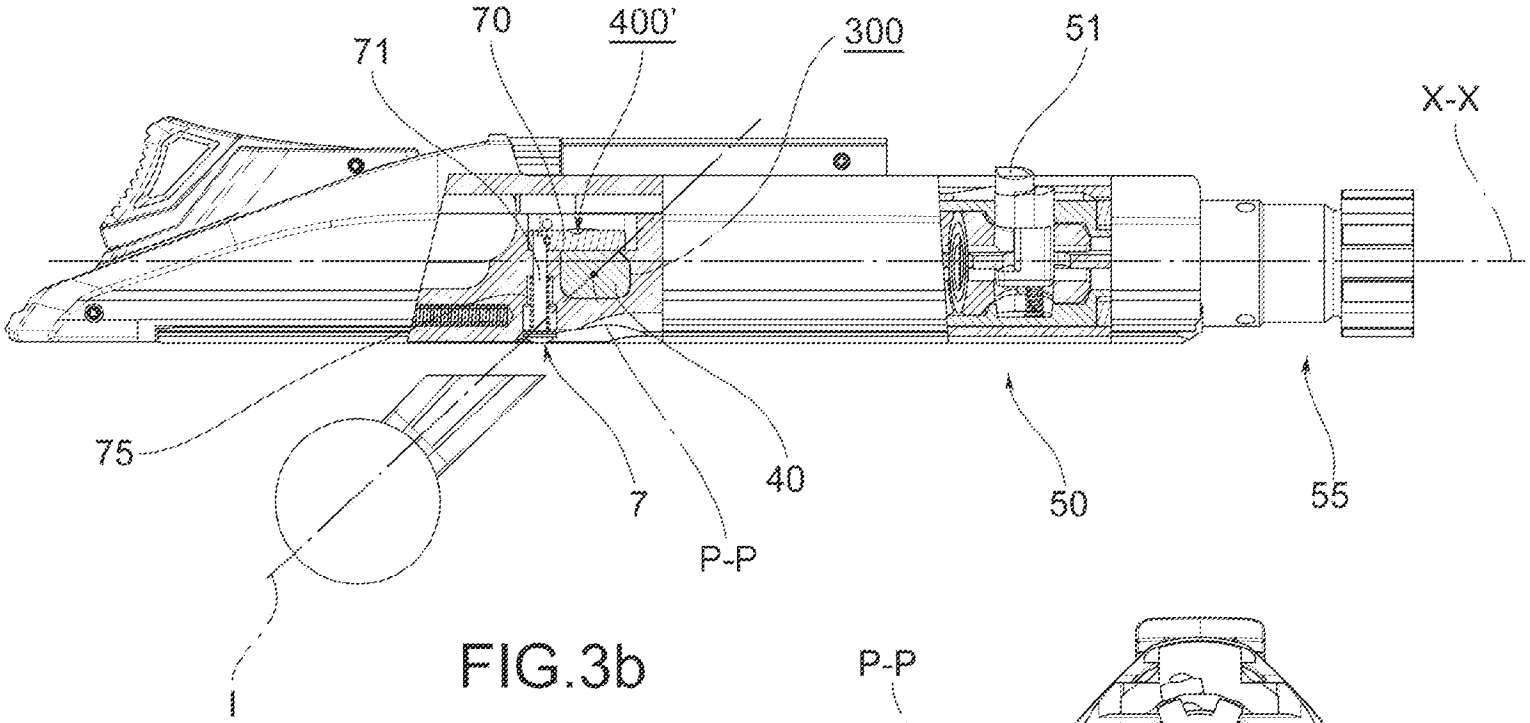
Figure 3C:
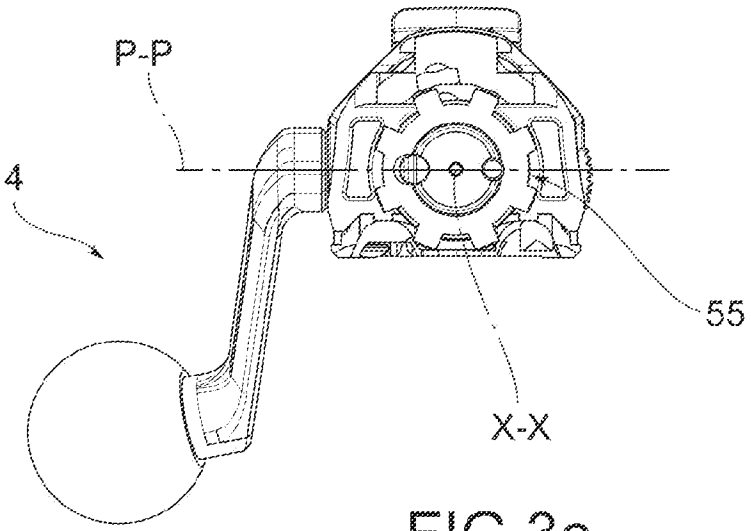
Figure 4:
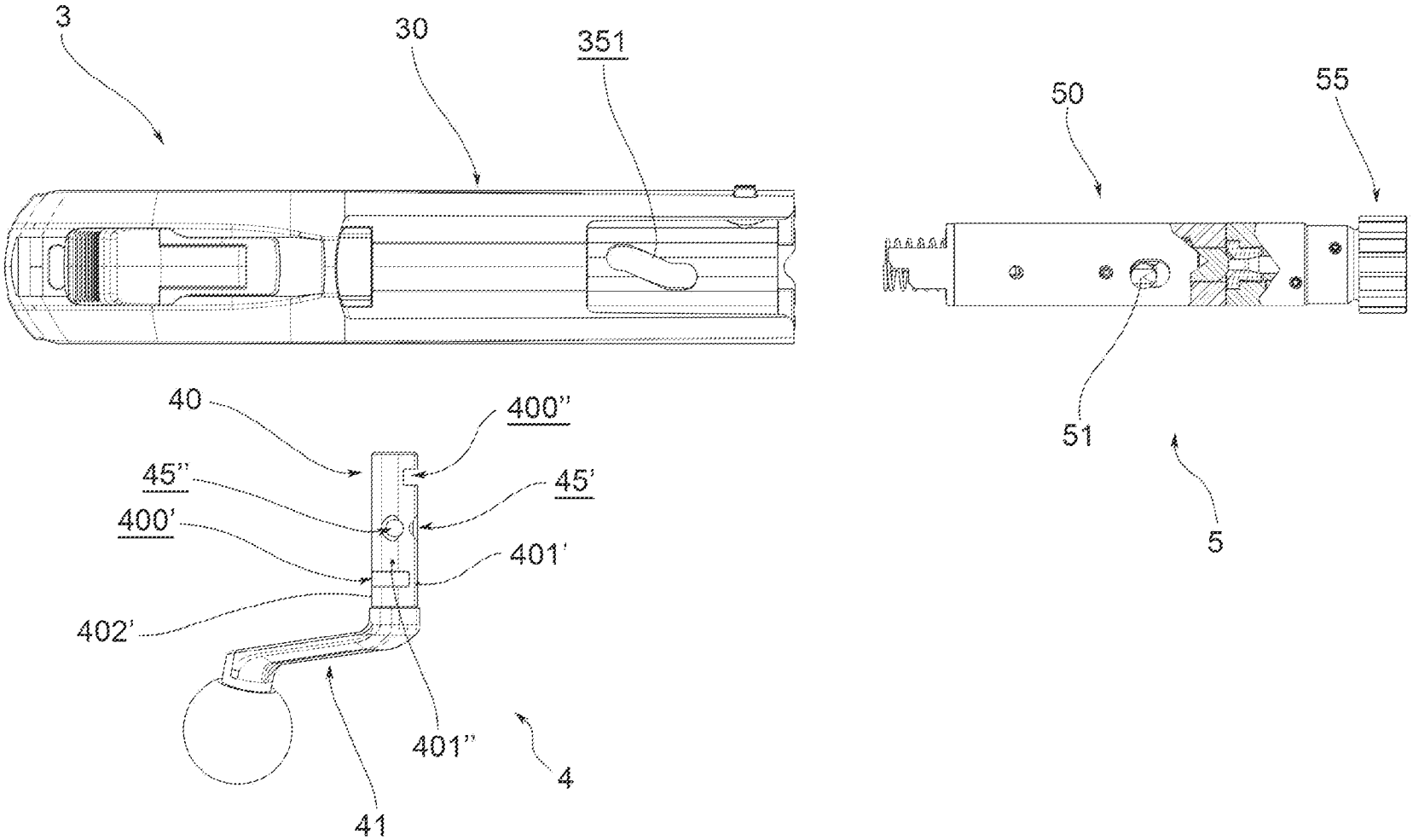
FIG. 4 is a view from above of separate parts of the carriage assembly shown in FIG. 2.
Figure 4:
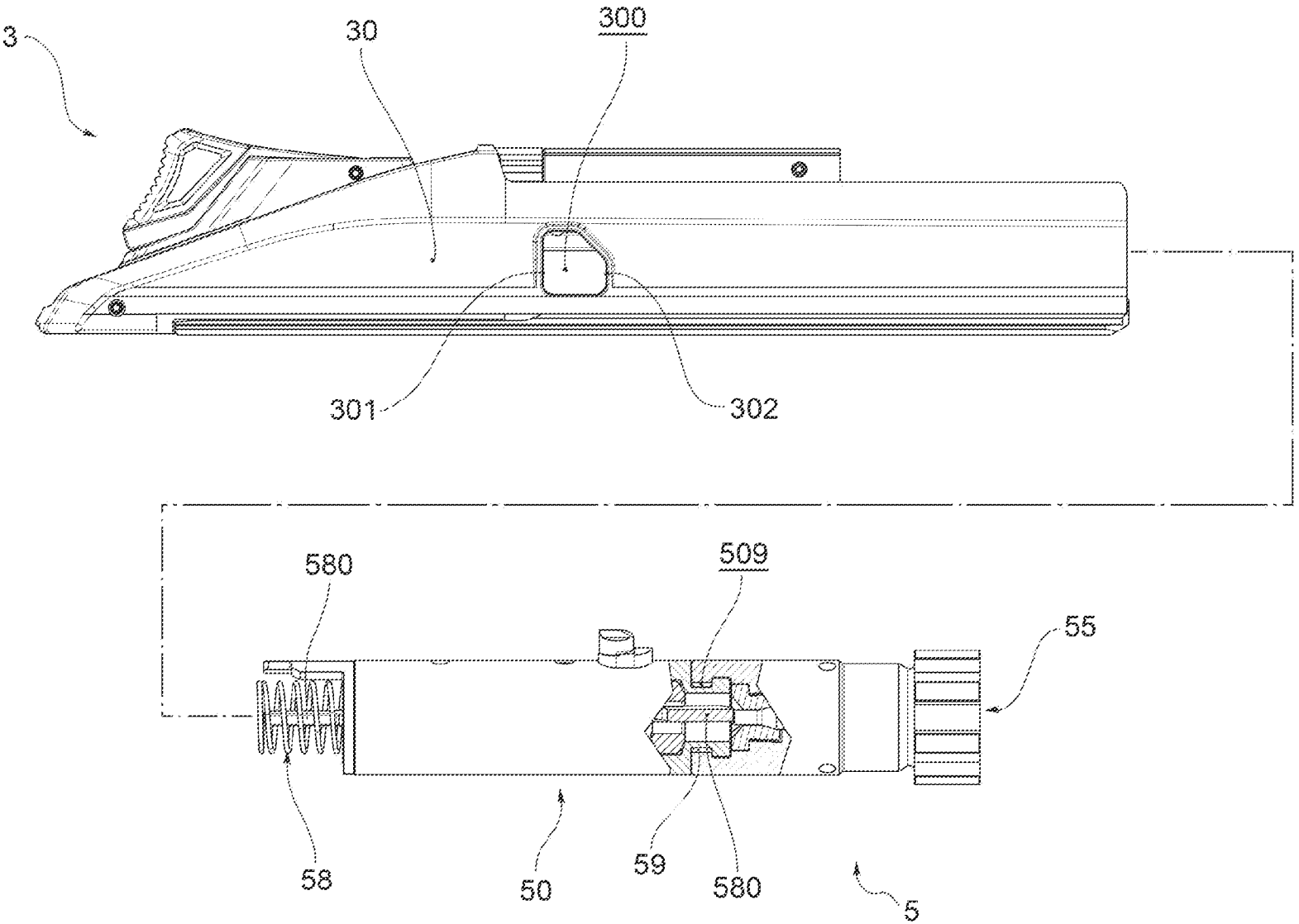
Figure 5A:
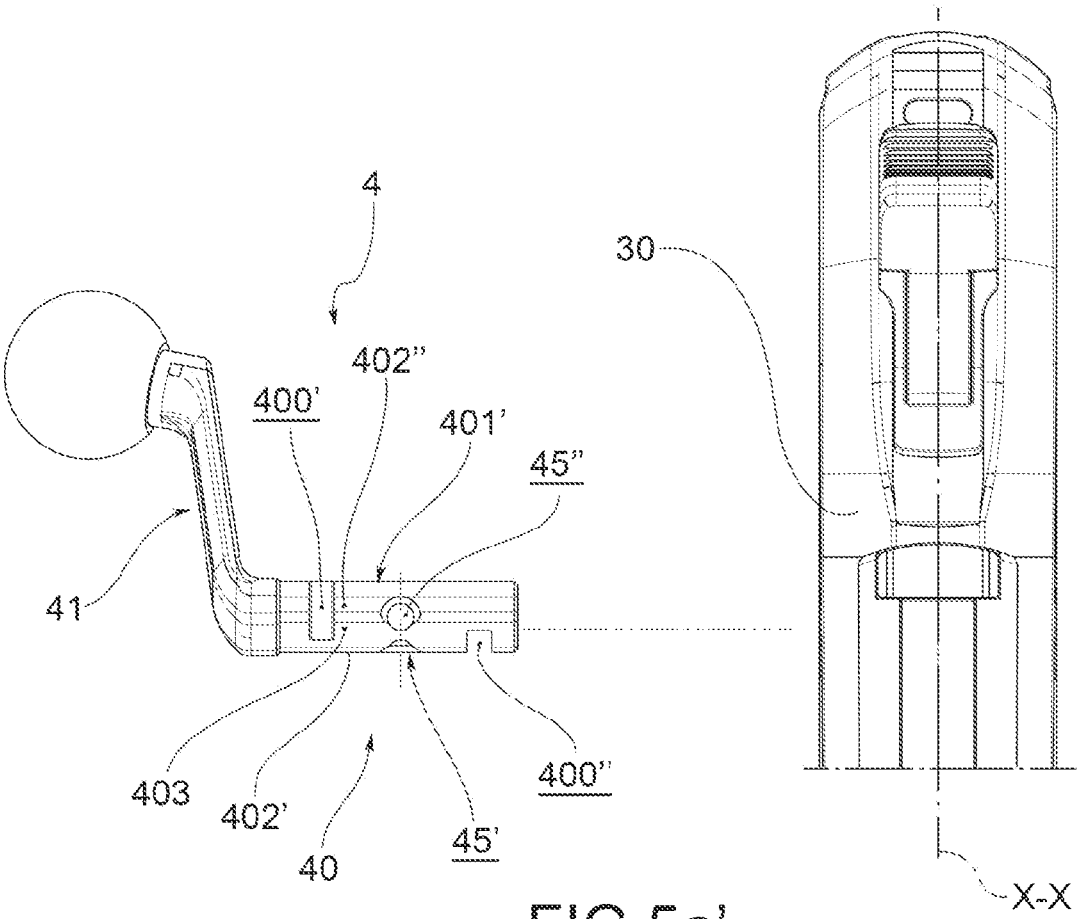
FIGS. 5*a*' and 5*b*' show, respectively, a top view of separate parts and a frontal view in partial cross section of the carriage assembly from the preceding figures according to a first user configuration.
Figure 5B:
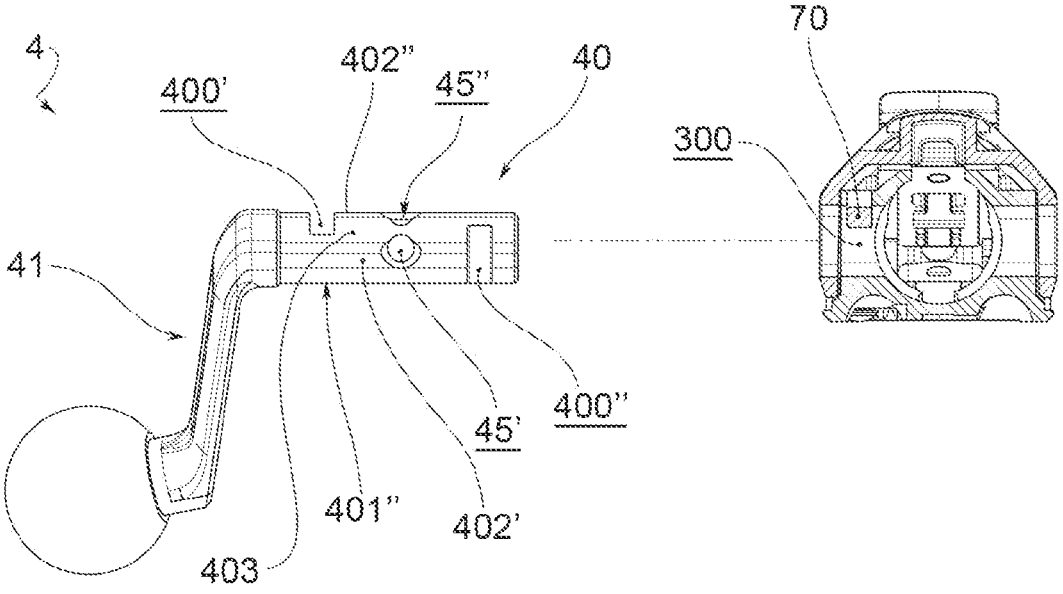
Figure 6A:
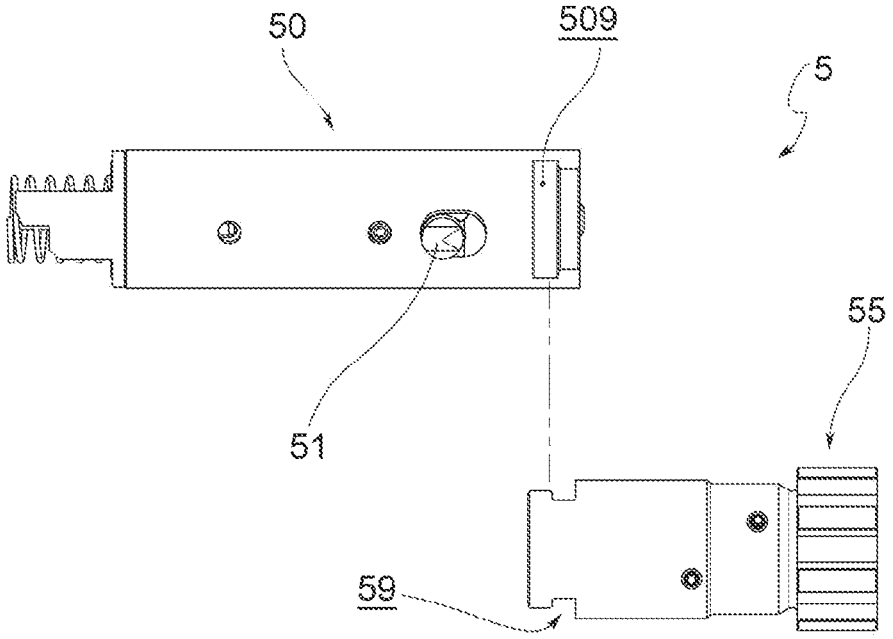
FIG. 6*a* shows a shutter group comprised within the carriage assembly from the preceding figures, in separate parts.
Figure 6:
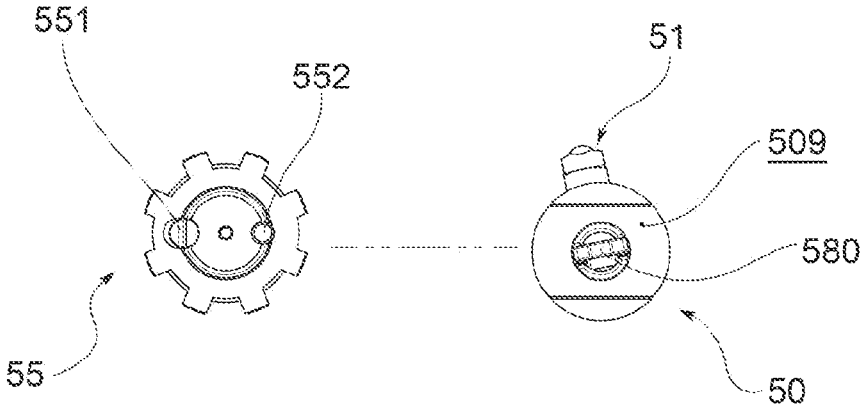
FIGS. 6' and 6" show, respectively, two front views of separate parts of the shutter group in a first user configuration and a second user configuration.
Figure 6:
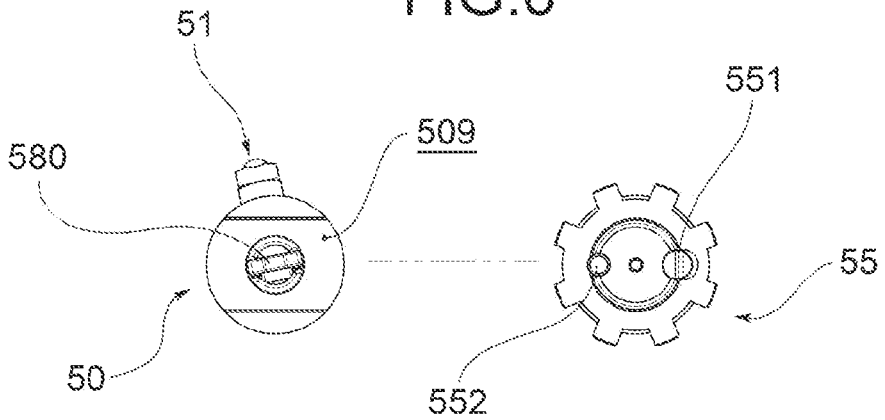
Figure 7:
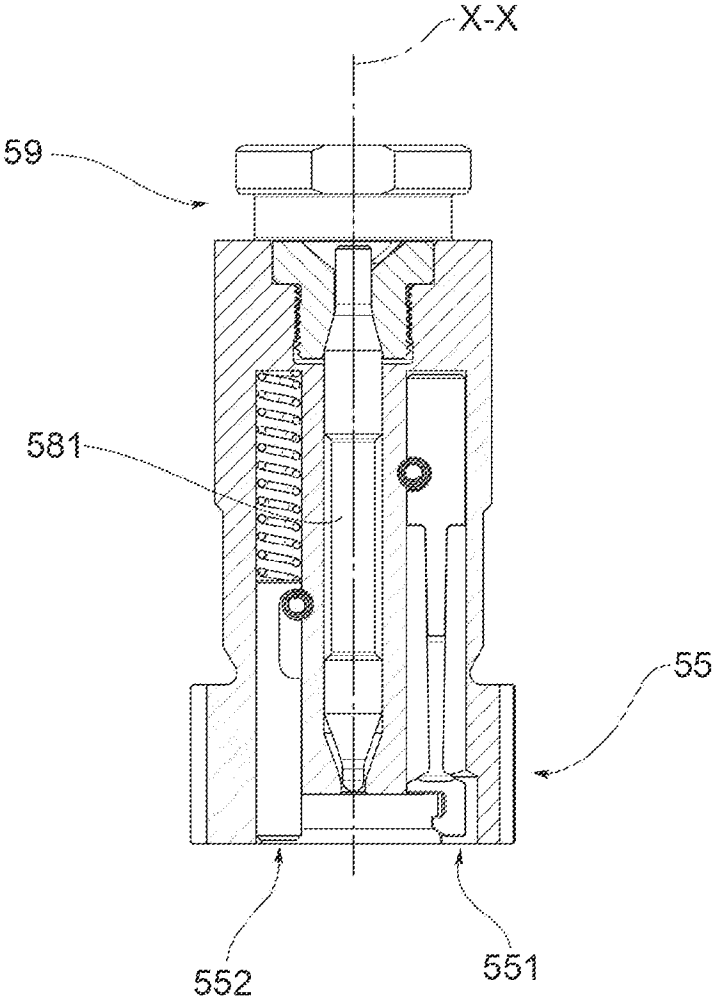
FIGS. 7' and 7" represent two views in axial cross section of a shutter head 55 in a first user configuration and a second user configuration.
Figure 7:
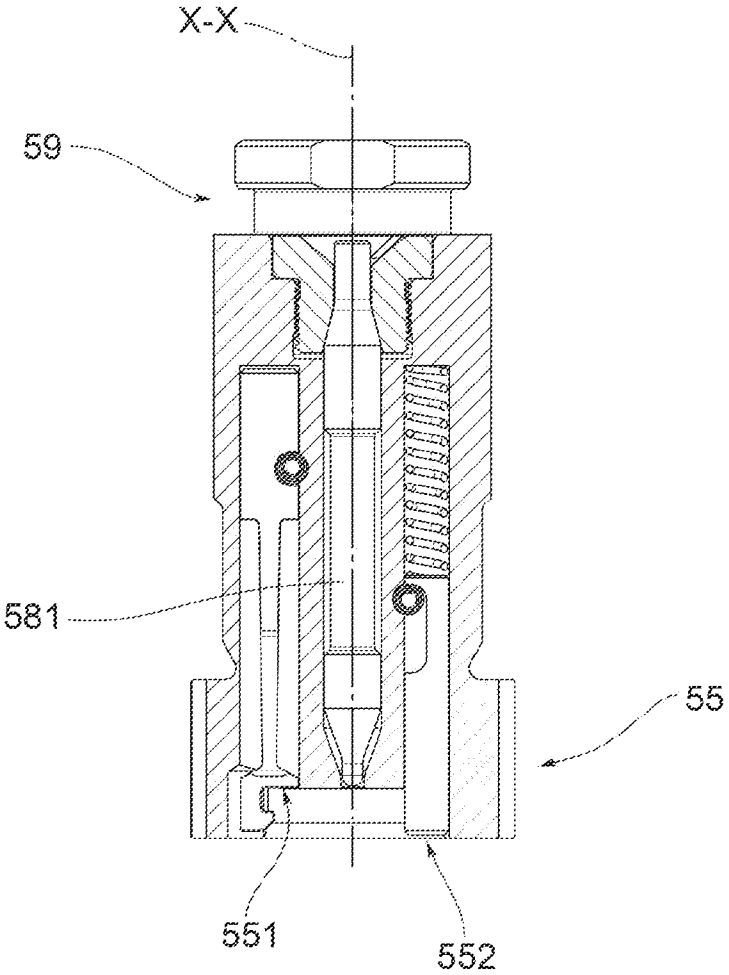

With reference to the accompanying figures, a rifle according to the present invention is indicated in the entirety thereof with the numeral 1.

The rifle 1 that is the subject of the present invention comprises a plurality of components that, by convention, are defined as fixed, and a plurality of components that are defined as movable.

According to the present invention, the rifle 1 comprises a fixed main body 2.

This main body 2 is graspable or holdable by the user, for example in the shooting or aiming operations, comprising a stock and/or a forend.

According to the present invention, the fixed body 2 comprises a barrel 9 which extends along an axis X-X. The axis X-X is therefore the barrel axis.

Preferably, reference to 'axial' movements or certain features or components means movements or features or components that occur or are positioned parallel to said X-X axis, i.e. parallel to the barrel 9. In certain cases, such movements or features or components are along the barrel axis X-X. Alternatively to the term "axial," the term "longitudinal" is also used.

According to the present invention, the main body 2 comprises a receiver 6.

Preferably, the receiver 6 is made of a material belonging to the family of metals or metal alloys, or of polymers, or polymeric materials, or composite materials.

According to the present invention, the receiver 6 has an upper opening 60.

In other words, the receiver 6 has an opening 60 facing in the vertical direction.

In still other words, the receiver 6 is a receiver "without a castle".

The receiver 6 is a hollow component suitable for containing components, shooting mechanisms, and the bullets.

Preferably, the barrel 9 extends from the receiver 6.

Preferably, the stock extends from the receiver 6.

Preferably, the forend extends from the receiver 6.

Preferably, the receiver 6 also comprises a lower opening 65. The bullets enter through said lower opening 65. Preferably, a magazine 900 is accommodated inside the receiver 6. Preferably, the magazine 900 is inserted via said lower opening 65. Preferably, the magazine 900 closes said lower opening 65.

According to a preferred embodiment, the main body 2 also comprises a breech element 8 positioned at an axial end of said upper opening 60.

According to a preferred embodiment, the breech element 8 extends in height, preferably in a vertical direction.

Preferably, the barrel 9 is mountable on the breech element 8 at an end opposite the firing mouth of the barrel 9.

According to a preferred embodiment, the breech element 8 is comprised within the barrel 9: the breech element 8 is the end that is axially opposite the firing mouth of the barrel 9.

According to a preferred embodiment, said components, listed in a non-limiting manner, that form part of the main body 2 are all reciprocally distinct components.

According to an embodiment variant, said components, listed in a non-limiting manner, that form part of the main body 2 are occasionally reciprocally of piece: some components are reciprocally integrally connected to one another.

According to a preferred embodiment, the rifle 1 comprises a trigger group operable by the user in order to execute a firing action.

The trigger group 10 is at least partially accommodated within the receiver 6.

Preferably, the trigger group 10 comprises a trigger 100 and a hammer device actuatable by the trigger 100.

According to the present invention, the rifle 1 comprises a carriage assembly 3 comprising a shutter group 5.

According to a preferred embodiment, the shutter group 5 also comprises striker members that are engageable by the operated hammer device 110.

More generally, the carriage assembly 3 comprises components, the movement of which and the operation of which involve a shooting action and a rearming action, i.e., discharging of the exploded case to the outside and the loading of the bullet from the magazine 500.

According to the present invention, the carriage assembly 3 is positioned on the receiver 6 at the upper opening 60.

According to a preferred embodiment, the carriage assembly 3 is positioned and has a shape suitable for closing said upper opening 60.

Preferably, the carriage assembly 3 slides on the axial edges that delimit the upper opening.

According to a preferred embodiment, the carriage assembly 3 comprises an assembly body 30 comprising appropriate assembly guides that are suitable for sliding on said axial edges.

According to the present invention, the carriage assembly 3 is axially movable by the user between an advanced shooting configuration and a retracted rearming configuration, and vice versa.

According to the present invention, in the advanced shooting configuration, the shutter group 5 engages the breech element 8, fully closing the upper opening 60. In said advanced configuration, the rifle 1 is therefore ready to execute the shooting action, acting with the trigger group 10, in particular with the hammer device 110 engaging the shutter group 5, in particular the striker members.

According to the present invention, in the retracted rearming configuration, the carriage assembly 3 is positioned in such a manner that the upper opening 60 is open. This means that the upper opening 60 is accessible from above. Preferably, the upper opening 60 is accessible both from above and from the sides.

In the retracted configuration, the rifle 1 has discharged the case, and is ready to be brought into the advanced shooting configuration. In said movement, the carriage assembly 3 is therefore suitable for reloading a bullet, which may then be the subject of the shooting action.

According to the present invention, the carriage assembly 3 comprises an assembly body 30. The shutter group 5 is accommodated in said assembly body 30.

According to the present invention, the carriage assembly 3 is moved by the user and the shutter group 5 is guided in movement by the carriage assembly 3: the shutter group 5 is guided in movement together with the assembly body 30 with respect to the receiver 6 and is guided in movement with respect to the assembly body 30.

Specifically, according to the present invention, regarding the axial movement of the carriage assembly 3 between the retracted configuration and the advanced configuration, the shutter group 5 is first moved axially in translation and then is moved in roto-translation.

According to the present invention, the carriage assembly 3 comprises a firearm handle 4 grippable by the user for executing said operations.

In particular, the assembly body 30 comprises a through housing 300 having a transverse extension.

In particular, said firearm handle 4 is configurable in a first user configuration and in a second user configuration.

According to the present invention, the firearm handle 4 comprises an outer portion 41 grippable by a user and an inner portion 40 specifically shaped for complementarily housing in the through housing 300, being insertable both on one side and on the other.

According to a preferred embodiment, the outer portion 41 comprises a gripping element, for example a knob.

According to a preferred embodiment, the outer portion 41 extends inclined with respect to the inner portion 40.

Preferably, the firearm handle 4 comprises an imaginary center line plane I that divides it into two halves. Preferably, therefore, in the first user configuration and in the second user configuration, the firearm handle 4 is positioned in mirror symmetry with respect to an imaginary plane passing through the axis X-X.

According to a preferred embodiment, the through housing 300 comprises two housing walls 301, 302 which are axially spaced apart and orthogonal to said axis X-X.

Preferably, the inner portion 40 is shaped so as to engage said housing walls 301, 302, on which to discharge the axial push and pull actions.

Preferably, the inner portion is shaped so as to engage said housing walls 301, 302 on which to discharge the axial push and pull actions, both in the first user configuration and in the second user configuration.

According to a preferred embodiment, the inner portion 40 comprises two pairs of handle walls 401', 401"; 402'; 402".

Preferably, in the insertion from the first side of the inner portion 40 into the through housing 300, the housing walls 301, 302 are engaged by the first pair of handle walls 401', 402'.

Preferably, in the insertion from the second side of the inner portion 40 into the through housing 300, the housing walls 301, 302 are engaged by the second pair of handle walls 401", 402".

According to a preferred embodiment, the inner portion 40 and the through housing 300 have complementary cross section with the shape substantially of an irregular polygon.

Preferably, the inner portion 40 comprises two first adjacent handle walls 401', 401" having a shape that is complementary to the first housing wall 301.

Preferably, the inner portion 40 also comprises two second handle walls 402', 402", each adjacent to a first handle wall 401', 401", having a shape complementary to the second housing wall 302.

According to a preferred embodiment, the two second handle walls 402', 402" are separated by a third handle wall 403.

Preferably, the first handle walls 401', 401" are positioned at 90° with respect to one another. Preferably, the second handle walls 402', 402" are positioned at 90° with respect to one another, joined by the third handle wall 403 positioned at 45°.

According to a preferred embodiment,

Preferably, the inner portion 40 is insertable into the through housing 300 in only one angular position in the first side and in only one angular position in the second side. Preferably, the two positions provide for a rotation of 90° with respect to the axis along which the inner portion 40 extends.

According to a preferred embodiment, the carriage assembly 3 comprises a handle locking member 7 that is engageable in the inner portion 40.

Preferably, the handle locking member 7 is accommodated on the assembly body 30. In particular, the handle locking member 7 is operable from the bottom of the carriage assembly 3.

According to a preferred embodiment, the handle locking member 7 is configurable in a locking configuration, in which it engages the inner portion 40 retaining the firearm handle 4 with the assembly body 30, and in a release configuration, in which the inner portion 40 disengages and the firearm handle 4 is removable from the assembly body 30.

According to a preferred embodiment, the inner portion 40 comprises at least one locking cavity 400', 400" and the handle locking member 7 comprises a tooth 70 suitable for housing in a relevant locking cavity 400', 400".

Preferably, the tooth 70 is accommodated in a first locking cavity 400' in the first user configuration and in the second locking cavity 400" in the second user configuration.

Preferably, the first locking cavity 400' the second locking cavity 400" are axially spaced apart along the inner portion 40.

According to a preferred embodiment, each locking cavity 400', 400" is positioned on a distinct handle wall, preferably on a second handle wall 402', 402". Preferably, the locking cavity 70 accommodated on the second handle wall 402', 402" and disengaged from the second housing wall 302 is engaged by the tooth 70.

According to a preferred embodiment, the handle locking member 70 comprises a button 71 suitable for engaging the tooth 70 in order to command it in said release configuration. Preferably, pushing the button moves the tooth 70 into a release position.

According to a preferred embodiment, the tooth 70 is movable between a lowered position corresponding to the locking configuration and a raised position corresponding to the release configuration.

According to a preferred embodiment, the handle locking member 7 comprises a spring 75 suitable for executing a pushing action, which retains the tooth 70 in a locking configuration.

Preferably, the button 71 overcomes the action of the spring 75 and moves the tooth 70.

According to a preferred embodiment, the button 71 is operable with the carriage assembly 3 removed from the receiver 6. Preferably, the pushbutton 71 is at the edge of the carriage assembly 3 facing the receiver 6.

Preferably, during the insertion operations, the inner portion 40 engages the tooth 70 and moves it into the release position until it is aligned with a locking cavity 400', 400" in which the tooth 70, on action of the spring 75, returns to the locking configuration.

According to a preferred embodiment, the shutter group 5 engages the inner portion 40 accommodated in the through housing 300. This means that the inner portion 40 follows an axial reaction to the shutter group 5.

According to a preferred embodiment, the shutter group 5 comprises striker members 58 comprising a striker rod 580 which lies on the axis X-X. Preferably, the striker rod 580 is suitable for crossing a hole 45', 45" provided on said inner portion 40.

Preferably, the inner portion 40 comprises two holes 45', 45", each of which are crossable by the striker rod 580 in the first user configuration or in the second user configuration.

Preferably, a first hole 45' crosses the first pair of handle walls 401', 402'. A second hole 45" crosses the second pair of handle walls 401", 402".

According to a preferred embodiment, the rifle 1 further comprises a shutter group 5 partially accommodated in said assembly body 30.

Said shutter group 5 comprises a shutter body 50 extending laterally and a shutter head 55 engaged with one end of the shutter body 50.

Preferably, the striker members 58 comprise a striker rod 580 extending in the shutter body 50 and a striker tip 581 extending in the shutter head 55.

Preferably, in the reciprocal engagement between the shutter body 50 and the shutter head 55, the striker rod 580 engages the striker tip 581.

According to the invention, the shutter head 55 is mountable onto the shutter body 50 in a first angular position and in a second angular position, which are reciprocally inverted.

According to a preferred embodiment, the shutter head 55 comprises an extractor element 551 and an ejector element 552 which are diametrically opposed. Preferably, the positioning of the shutter head 55 in the first angular position has the extractor element 551 on one side and the ejector element 552 on the other side, and vice versa in the second angular position.

Depending on the position of the extractor element 551 and of the ejector element 552, the case is ejected out of the rifle 1 to the right or to the left.

According to a preferred embodiment, the shutter body 50 and the shutter head 55 are mutually engageable with an operation which occurs in the diametral direction.

Preferably, the shutter body 50 and the shutter head 55 comprise diametral engagement means 509, 59, comprising a diametral guide 509 and diametral sliding means 59 which are reciprocally insertable into one another in a radial/diametral direction.

According to a preferred embodiment, the shutter group 5 comprises a radial retaining pin 51 suitable for retaining the shutter group 5 with the assembly body 30.

Preferably, the assembly body 30 comprises a command cavity 351 having a main axial extension, but variable trajectory. Preferably, said radial retaining pin 51 houses in said command cavity 351 and is axially movable between the ends of said command cavity 351', 351".

Preferably, the insertion of the shutter group 5, in particular the shutter group 50, inside the assembly body 30 occurs with the radial retaining pin 51 pressed.

According to a preferred embodiment, the engagement region between the shutter body 50 and the shutter head 55 houses within the assembly body 30. Preferably, the shutter body 50 and the shutter head 55 are disengageable from one another, by means of said diametral action, only after the loosening of the shutter group 5 from the assembly body 30.

Innovatively, the rifle that is the subject of the present invention fully meets the predetermined object.

Advantageously, the rifle that is the subject of the present invention is an alternative solution to the known ones, but which resolves the typical problems of such solutions.

Advantageously, the rifle that is the subject of the present invention is configurable and ready for use both by a right-handed user and by a left-handed user by means of simple and intuitive operations.

Advantageously, the firearm handle is positionable in a simple and intuitive manner in a position operable from the right and in a position operable from the left.

Advantageously, the firearm handle engages the assembly body in an efficient manner in order to interact with it in a reliable and solid manner.

Advantageously, the disengagement of the firearm handle from the assembly body is executable only by operating the handle locking member.

Advantageously, the handle locking member is accessible only with the carriage assembly removed from the receiver.

Advantageously, the shutter group is designed to be easily reconfigurable for discharging the case on the right side or on the left side according to preference and necessity.

It is clear that a person skilled in the art may make changes to the invention described above in order to meet contingent needs, which changes all fall within the scope of protection as defined in the following claims.

The invention claimed is:

1. A rifle comprising:

i) a main body, fixed, comprising a barrel which extends along an axis, a receiver comprising an upper opening, a breech element positioned at an axial end of said upper opening;

ii) a carriage assembly comprising:

an assembly body positioned on the receiver at the upper opening, which is axially slidably movable, comprising a through housing extending transversely;

a firearm handle comprising an outer portion grippable by a user and an inner portion shaped for complementarily housing in the through housing, being insertable both on one side and on an other side;

a shutter group partially housed in said assembly body comprising a shutter body extending axially, and a shutter head engaged with one end of the shutter body, wherein the shutter head is mountable onto the shutter body in a first angular position and in a second angular position, which are reciprocally inverted;

wherein the carriage assembly is axially movable between an advanced shooting configuration, in which the shutter group engages the breech element, and a retracted rearming configuration, in which the upper opening is open, and the shutter group is spaced apart from the breech element, and vice versa;

wherein the rifle is configurable for a right-handed or a left-handed person, by changing a position of the firearm handle and the position of the shutter head.

2. The rifle according to claim 1, wherein the through housing comprises two housing walls, which are axially spaced apart and orthogonal to said axis, wherein the inner portion comprises a first pair of handle walls and a second pair of handle walls, wherein, in insertion from a first side of the inner portion in the through housing the housing walls are engaged by the first pair of handle walls, while, in the insertion from a second side of the inner portion in the through housing the housing walls are engaged by the second pair of handle walls.

3. The rifle according to claim 2, wherein the inner portion and the through housing complementarily have a section with a substantially irregular polygon shape.

4. The rifle according to claim 1, wherein the outer portion extends inclined with respect to the inner portion, wherein the firearm handle comprises an imaginary center line plane, which divides the firearm handle into two halves.

5. The rifle according to claim 1, wherein the shutter group engages the inner portion housed in the through housing, wherein the shutter group comprises striker members comprising a striker rod, which lies on the axis and is configured for crossing a hole provided on said inner portion.

6. The rifle according to claim 1, wherein the carriage assembly comprises a handle locking member housed on the assembly body, configurable in a locking configuration, in which the handle locking member engages the inner portion retaining the firearm handle with the assembly body and in a release configuration, in which the handle locking member disengages the inner portion, and the firearm handle is removable from the assembly body.

7. The rifle according to claim 6, wherein the inner portion comprises at least one locking cavity and the handle locking member comprises a tooth, for housing in a respective locking cavity and a button configured for engaging the tooth to control the tooth in said release configuration.

8. The rifle according to claim 4, wherein the tooth is movable between a lowered position corresponding to a locking configuration, and a raised position corresponding to a release configuration.

9. The rifle according to claim 1, wherein the handle locking member comprises a spring configured for executing a thrust action, keeping the tooth in a locking configuration.

10. The rifle according to claim 1, wherein the shutter head comprises an extractor element and an ejector element, which are diametrically opposite, wherein positioning of the shutter head in the first angular position has the extractor element on one side and the ejector element on the other side, and vice versa, in the second angular position.

11. The rifle according to claim 1, wherein the shutter body and the shutter head are mutually engageable with an operation, which occurs in a diametral direction.

12. The rifle according to claim 11, wherein the shutter body and the shutter head comprise a diametral guide and a diametral slider, which are reciprocally insertable into one another with a diametral action.

13. The rifle according to claim 1, wherein the shutter group comprises a radial retaining pin configured for retaining the shutter group with the assembly body.

14. The rifle according to claim 13, wherein the assembly body comprises a command cavity having a main axial extension, wherein said radial retaining pin is housed in said command cavity and is axially movable between ends of said command cavity.

* * * * *